US011603743B2

(12) United States Patent
Pang et al.

(10) Patent No.: US 11,603,743 B2
(45) Date of Patent: Mar. 14, 2023

(54) NETWORK OF SINGLE STRAIGHT-LINE CONNECTIONS BETWEEN FRAC TREES

(71) Applicant: SPM Oil & Gas PC LLC, Fort Worth, TX (US)

(72) Inventors: Ray Dicksang Pang, Missouri City, TX (US); Russell Hamilton, Houston, TX (US); Phu Duc Sy Dong, Houston, TX (US); Brandon Travis Dodge, Troy, PA (US)

(73) Assignee: SPM Oil & Gas Inc., Fort Worth, TX (US)

( * ) Notice: Subject to any disclaimer, the term of this patent is extended or adjusted under 35 U.S.C. 154(b) by 0 days.

(21) Appl. No.: 17/439,709

(22) PCT Filed: Mar. 27, 2020

(86) PCT No.: PCT/US2020/025370

§ 371 (c)(1),
(2) Date: Sep. 15, 2021

(87) PCT Pub. No.: WO2020/205577

PCT Pub. Date: Oct. 8, 2020

(65) Prior Publication Data

US 2022/0162934 A1 May 26, 2022

Related U.S. Application Data

(60) Provisional application No. 62/826,943, filed on Mar. 29, 2019.

(51) Int. Cl.

| | |
|---|---|
| ***E21B 47/12*** | (2012.01) |
| ***E21B 47/107*** | (2012.01) |
| ***E21B 47/017*** | (2012.01) |
| ***G01N 23/203*** | (2006.01) |
| ***G01V 3/34*** | (2006.01) |

(Continued)

(52) U.S. Cl.

CPC ..... *E21B 43/2607* (2020.05); *E21B 33/068* (2013.01); *E21B 2200/04* (2020.05); *E21B 2200/05* (2020.05); *E21B 2200/06* (2020.05)

(58) Field of Classification Search

None

See application file for complete search history.

(56) References Cited

U.S. PATENT DOCUMENTS

| | | | | |
|---|---|---|---|---|
| 2013/0175038 | A1 | 7/2013 | Conrad | |
| 2013/0233560 | A1* | 9/2013 | Davidson | E21B 43/26 166/308.1 |
| 2017/0130555 | A1* | 5/2017 | Kajaria | E21B 33/068 |

(Continued)

OTHER PUBLICATIONS

International Search Report and Written Opinion for PCT/US2020/025370 dated Jun. 9, 2020, 14 pages.

*Primary Examiner* — Matthew Troutman
*Assistant Examiner* — Douglas S Wood

(57) ABSTRACT

A system for delivering hydraulic fracturing fluid to a wellbore is provided. The system includes a first frac tree connected to a first wellbore and a second frac tree connected to second wellbore. The system further includes a zipper module and a first single straight-line connection between the zipper module and the first frac tree. The system also includes a second single straight-line connection between the first frac tree and the second frac tree.

20 Claims, 8 Drawing Sheets

(51) Int. Cl.
*E21B 43/26* (2006.01)
*E21B 33/068* (2006.01)

(56) References Cited

U.S. PATENT DOCUMENTS

| | | | | |
|---|---|---|---|---|
| 2017/0370172 | A1* | 12/2017 | Tran | E21B 43/26 |
| 2018/0058171 | A1 | 3/2018 | Roesner et al. | |
| 2018/0224044 | A1 | 8/2018 | Penney et al. | |
| 2019/0010781 | A1* | 1/2019 | Tran | E21B 34/025 |
| 2020/0224508 | A1* | 7/2020 | Chapman | E21B 47/008 |

* cited by examiner

NETWORK OF SINGLE STRAIGHT-LINE CONNECTIONS BETWEEN FRAC TREES

CROSS-REFERENCE TO RELATED APPLICATION

This application is filed under 35 U.S.C. 371, and claims the benefit of and priority to PCT/US2020/025370, having a filing date of Mar. 27, 2020, entitled "NETWORK OF SINGLE STRAIGHT-LINE CONNECTIONS BETWEEN FRAC TREES," which claims the benefit of and priority to U.S. Provisional Patent Application No. 62/826,943 having a filing date of Mar. 29, 2019, both of which are incorporated herein by reference in their entirety for all purposes.

BACKGROUND

Oil and gas exploration requires complex industrial equipment to be interconnected at a well site in a precise manner. Typically, a drilling rig or well head is connected to a pump of some type to drive drilling and mining operations. A particular site may have numerous wells that are drilled. To improve production at these sites, fluids may be pumped down these well holes to fracture subterranean layers and thereby free oil and natural gas. This process is commonly referred to as "hydraulic fracturing" or simply "fracking." Hydraulic fracturing produces fractures in the rock formation that stimulate the flow of natural gas or oil, increasing the volumes that can be recovered. Fractures are created by pumping large quantities of fluids at high pressure down a wellbore and into the target rock formation.

Fracking requires specialized equipment to pump fluids, at varying pressures, to the holes. This is conventionally done by a "frac" pump supplying fluids ("frack fluids") to the well head for selective delivery down the well hole. Frack fluids are conveyed from frac pumps to wellheads using interconnected mechanical networks of piping, commonly referred to in the industry as "flow iron." In essence, the flow iron piping must provide flow paths for varying degrees of pressurized fracking fluids, such as sand, proppant, water, acids, or mixtures thereof. Fracking fluid commonly consists of water, proppant, and chemical additives that open and enlarge fractures within the rock formation. These fractures can extend several hundred feet away from the wellbore. The proppants—sand, ceramic pellets, acids, or other small incompressible particles—hold open the newly created fractures.

SUMMARY

The examples and embodiment disclosed herein are described in detail below with reference to the accompanying drawings. The below Summary is provided to illustrate some examples disclosed herein, and is not meant to necessarily limit all systems, methods, or sequences of operation of the examples and embodiments disclosed herein.

According to a first aspect, there is provided a system having a first frac tree connected to a first wellbore and a second frac tree connected to second wellbore. The system further includes a zipper module. A first single straight-line connection is disposed between the zipper module and the first frac tree. A second single straight-line connection between the first frac tree and the second frac tree.

In another embodiment, the system includes fluid channels defined within the first frac tree, the second frac tree, the zipper module, the first single straight-line connection, and the second straight-line connection for hydraulic fracturing fluid to be supplied from the zipper module to the first and second frac trees.

In still another embodiment, the system also includes a third frac tree connected to a third wellbore and a third single straight-line connection between the second frac tree and the third frac tree.

In yet another embodiment, the zipper module is situated on a base that is adjustable in elevation.

In yet another embodiment, the zipper module includes at least one rotatable block for receiving the frac fluid.

In still another embodiment, the system further includes a first valve and a second valve. The single straight line connection extends between the first and second valves.

In yet another embodiment, the first and second valves are at least one of manually actuatable or automatically actuatable.

In still another embodiment, the first and second valves are selected from the group consisting of a plug valve, a gate valve and a ball valve According to a second aspect, there is provided a system or delivering hydraulic fracturing fluid to a wellbore. The system includes a plurality of pumps fluidly connected to a manifold for delivering fluid to a zipper module. A first frac tree is adapted to be connected to a first wellbore and a second frac tree adapted to be connected to a second wellbore. The system also includes a first single straight-line connection between the zipper module and the first frac tree and a second single straight-line connection between the first frac tree and the second frac tree.

In another embodiment, the system also includes third frac tree adapted to be connected to a third wellbore and a third single straight-line connection between the first frac tree and the third frac tree.

In still another embodiment, the system also includes a third frac tree adapted to be connected to a third wellbore and a third single straight-line connection between the second frac tree and the third frac tree.

In yet another embodiment, fluid channels are defined within the first frac tree, the second frac tree, the zipper module, the first single straight-line connection, and the second straight-line connection for the hydraulic fracturing fluid to be supplied from the zipper module to the first frac tree and the second frac tree.

In still another embodiment, the zipper module is situated on a base that is adjustable in elevation.

In yet another embodiment, the zipper module includes at least one rotatable block for receiving the frac fluid.

According to a third aspect, there is provided a method for delivering hydraulic fracturing fluid to a wellbore. The method includes positioning a zipper module for connection to a first frac tree and a second frac tree and coupling a first single straight line connection to the zipper module and the first frac tree to fluidly connect the first frac tree and the second frac tree. The method also includes coupling a second single straight line connection to the first frac tree and the second frac tree to fluidly connect the first frac tree and the second frac tree.

According to one embodiment, the method further includes coupling a third single straight line connection to the first frac tree to fluidly connect the first frac tree and the third frac tree.

In yet another embodiment, the method also includes coupling a third single straight line connection to the second frac tree to fluidly connect the second frac tree to the third frac tree.

In still another embodiment, the method includes providing a base to support the zipper module and adjusting the elevation of the zipper module with respect to the base.

In another embodiment, the method includes providing a rotatable block on the zipper module to rotationally position at least a portion of the zipper module.

In still other embodiments, the method includes providing a first valve and a second valve, the first single straight line connection extends between the first and second valves.

Oher aspects, features, and advantages will become apparent from the following detailed description when taken in conjunction with the accompanying drawings, which are a part of this disclosure and which illustrate, by way of example, principles of the inventions disclosed.

DETAILED DESCRIPTION

Figure 1:
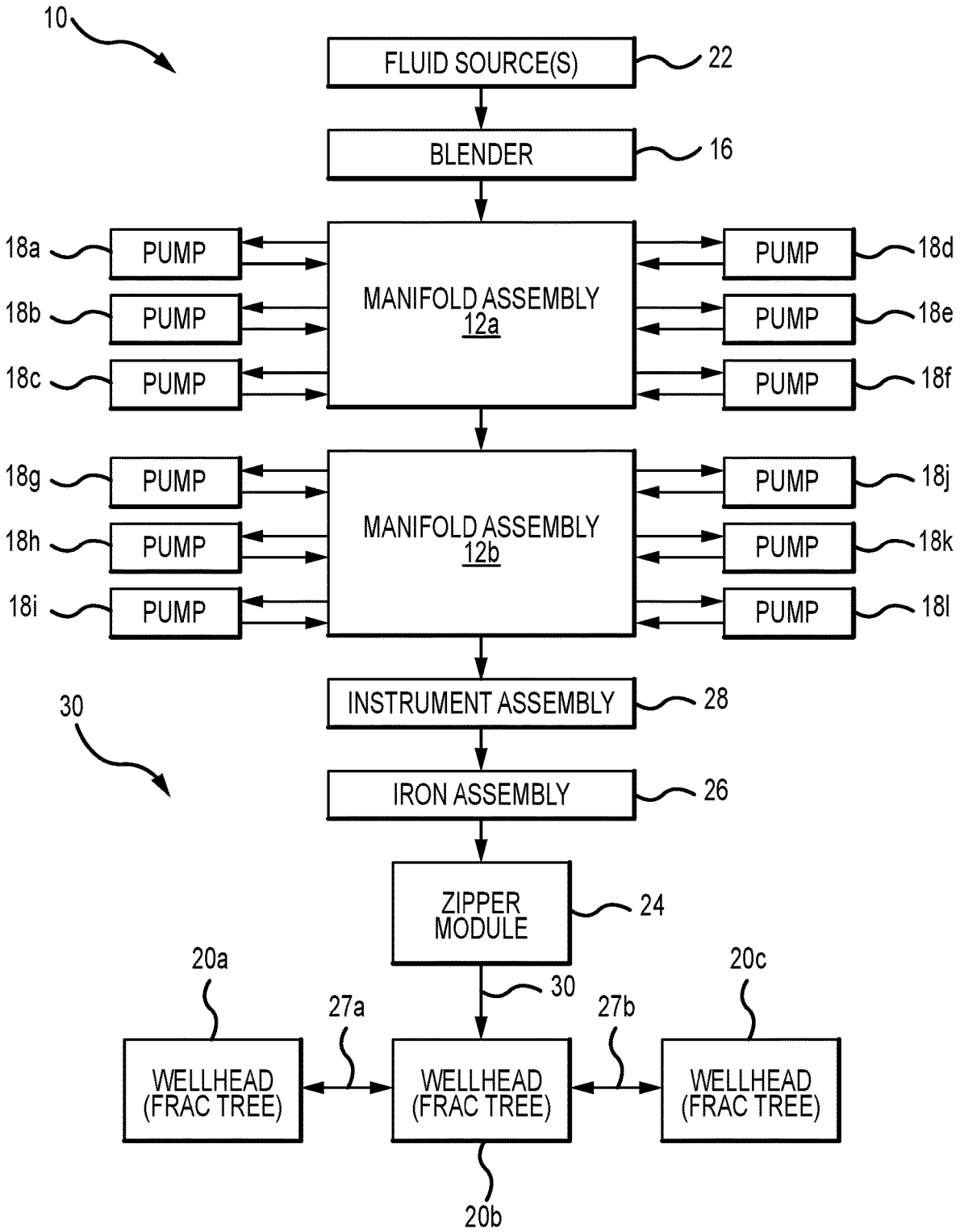
FIG. 1 is a block diagram of a system for supplying fracturing fluid to a wellhead through a network of single straight-line connections between the frac trees, according to one example.

Embodiments described herein generally refer to single straight-line connections between a fracturing tree (or "frac tree," commonly called a "Christmas tree") and various pressure-pumping or flowback equipment. Generally, the examples disclosed herein are directed to a dramatically simplified architecture for distributing frack fluid to frac trees sitting atop wellheads. In some examples, the frack fluid is delivered through various piping to a single zipper manifold, or zipper module, and then supplied from the zipper manifold to a first frac tree. This frac tree is connected via single straight-line connections to other frac trees to the deliver the frac fluid thereto. A delivery fluid passage network is created between the wellheads through their respective frac trees, and only a single point of delivery (the zipper manifold) is needed to supply all of the frac trees with frac fluid.

For purposes of this disclosure, a "single straight-line" and "one straight-line" connection refers to a series of pipes (e.g., plug, gate, etc.), valves, or other frac iron connected together to define an internal path, or conduit, for frack fluid to respectively flow therethrough, referred hereinafter to an OSL connection. As described in more detail below, the OSL connections formed from the connected pipes, gates, or other frac iron may connect may be used to provide a fluid path for frack fluid between a zipper module and a frac tree (or Christmas tree), and between two separate frac trees.

"Straight line," in reference to the single straight-line connections described herein, means a straight path at a constant height, through a midpoint of a fluid pathway created by the connected pipes, valves, or other frac iron, between a frac tree and zipper module or between two frac trees. In other words, in some embodiments, the single straight-line connections have no bends, or curves, defining a fluid channel that is a true straight flow path. For example, a single straight-line connection may have a straight line between the fluid path within fluid channels of the pipes, valves, or frac iron have an inner midpoint that measures 5, 6, 7, or 10 feet high all the way between a zipper module and a frac tree or between two frac trees. Not all embodiments are limited to a constant height, however. Alternatively, in some embodiments, the single straight-line connections described herein may be angled. For example, a single straight-line connection between two frac trees may be angled upward, downward, leftward, or rightward at an angle of 1-15 degrees (e.g., 1, 2, 3, 4, 5, 6, 7, 8, 9, 10, 11, 12, 13, 14, or 15 degrees).

The OSL connections disclosed herein are used to deliver frack fluid to a multitude of frac trees. The OSL connections are much less complicated than conventional connections between zipper modules and frac trees, providing both single-point and straight connections between frac trees.

The OSL connections disclosed herein may be formed by different combinations of "frac iron." Frac iron, as referenced herein, refers to component parts used to frack a well or capture flowback. Frac iron may include, for example, high pressure treating iron, and other pipes, joints, valves, and fittings; swivel joints, pup joints, plug valves, check valves and relief valves; ball injector, crow's foot, air chamber, crossover, hose, pipes/piping, hose loop, ball injector tee body, tee, wye, lateral, ell, check valve, plug valve, wellhead adapter, swivel joint, plug, relief valve; or the like.

FIG. 1 illustrates a block diagram of an example of a hydraulic fracturing ("fracking" or "frac") site 10 for hydraulic fracking of a subterranean layer for oil and gas extraction in which a network of single straight-line connections between frac trees is employed to advantage. In operation, the frac site 10 is used to facilitate oil and gas exploration and production operations. It should be understood that the embodiments provided herein are not, however, limited to a hydraulic frac system, as the embodiments may be used with, or adapted to, a mud pump system, a well treatment system, flowback system, other pumping systems, one or more systems at the wellheads 20*a*-20*c*, one or more systems upstream of the wellheads 20*a*-20*c*, one or more systems downstream of the wellheads 20*a*-20*c*, or one or more other systems associated with the wellheads 20*a*-20*c*.

In the embodiment illustrated in FIG. 1, the frac site 10 includes manifold assemblies 12*a* and 12*b*. The manifold assemblies 12*a* and 12*b* are in fluid communication with a blender 16, pumps 18*a*-181, and an instrument assembly 28. One or more fluid sources 22 are in fluid communication with the blender 16. In operation, the pumps 18*a*-181 receive low-pressure frac fluid from the manifold assemblies 12*a* and 12*b*, pressurize the frack fluid to a different and/or higher pressure, and return the pressured frack fluid to the manifold assemblies 12*a* and 12*b*. The frack fluid is passed through the iron assembly 26, monitored by the instrument assembly 28 to a zipper module 24 and eventual distribution to a series of wellheads 20*a*-20*c* that are disposed atop exploration wells (not illustrated).

According to embodiments disclosed herein, the zipper module 24 represents a vertical structure of flow iron used to elevate frac fluid from the iron assembly 26 to an OSL connection 30. As discussed in greater detail below, the zipper modules 24 can vary in design, having different types of valves, including, for example, globe valves, gate valves, ball valves and the like, both manually and automatically actuated depending on the particular application and/or setup. In FIG. 1, the wellheads 20*a*-20*c* represent frac trees (or Christmas trees) for receiving the frac fluid from the zipper module 24 via the OSL connection 30 and supplying the frac fluid to various oil and gas wells. Similar to the zipper modules 24, and as discussed in greater detail below, the frac trees can vary in design, having different types of valves, including, for example, globe valves, gate valves, ball valves and the like, and both manually and automatically actuated, depending on the particular application and/or setup.

In some embodiments, the OSL connection 30 is used to provide straight-line fluid pathways between the zipper module 24 and the wellheads 20*a*-20*c*. For example, the OSL connection 30 provides fluid communication of frac fluid between zipper module 24 and the wellhead 20*b*, which, as discussed in greater detail below, is then further distributed to wellheads 20*a* and 20*c* via OSL connections 27*a* and 27*b*, respectively. However, it should be understood that other configurations can be used. For example, in other embodiments, the OSL connection 30 provides fluid communication of frac fluid between the zipper module 24 and the wellhead 20*a*. In still other embodiments, the OSL connection 30 provides fluid communication of frac fluid between the zipper module 24 and the wellhead 20*c*.

Referring now to FIGS. 2-5, the wellheads 20*a*-20*c* are each located at the top or head of an oil and gas wellbore (not shown), which penetrates one or more subterranean formations (not shown), and are used in oil and gas exploration and production operations. Each of the wellheads 20*a*-20*c* is equipped with a respective frac tree 50*a*, 50*b*, 50*c* affixed atop the wellhead 20*a*, 20*b*, 20*c*, respectively (also indicated in FIG. 1 in parentheticals). For the sake of clarity, the terms "wellhead" and "frac tree" are used synonymously insofar as embodiments and examples referencing a zipper module 24 being connected to a wellhead actually refers to the zipper module being connected to the frac tree atop the wellhead. In operation, the wellheads 20*a*-20*c* are in fluid communication with the manifold assemblies 12*a* and 12*b* via, for example, a single zipper module 24, an iron assembly 26, and the instrument assembly 28 as seen in FIG. 1.

Figure 2:
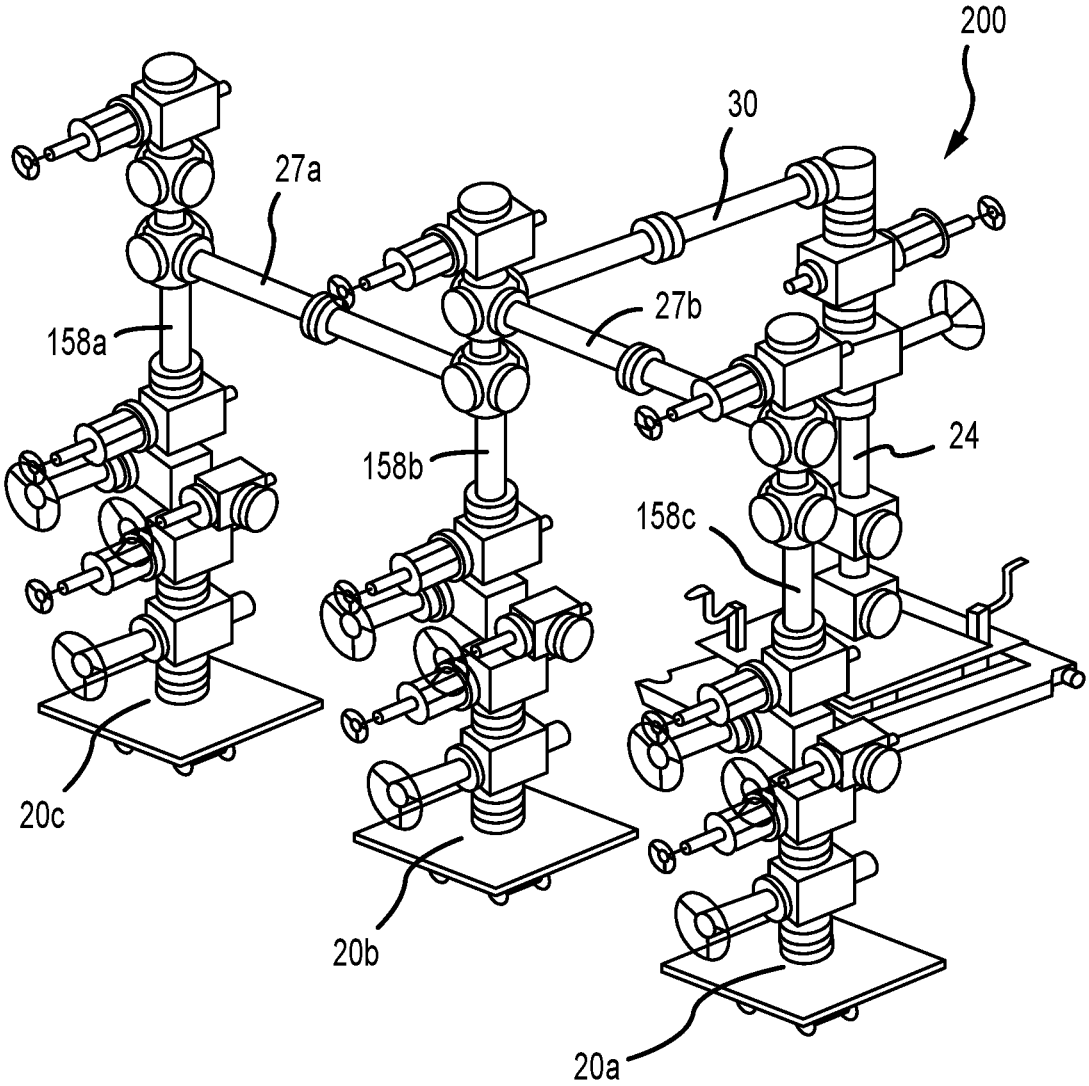
FIG. 2 illustrate a front perspective view of a system for supplying fracturing fluid.
Figure 3:
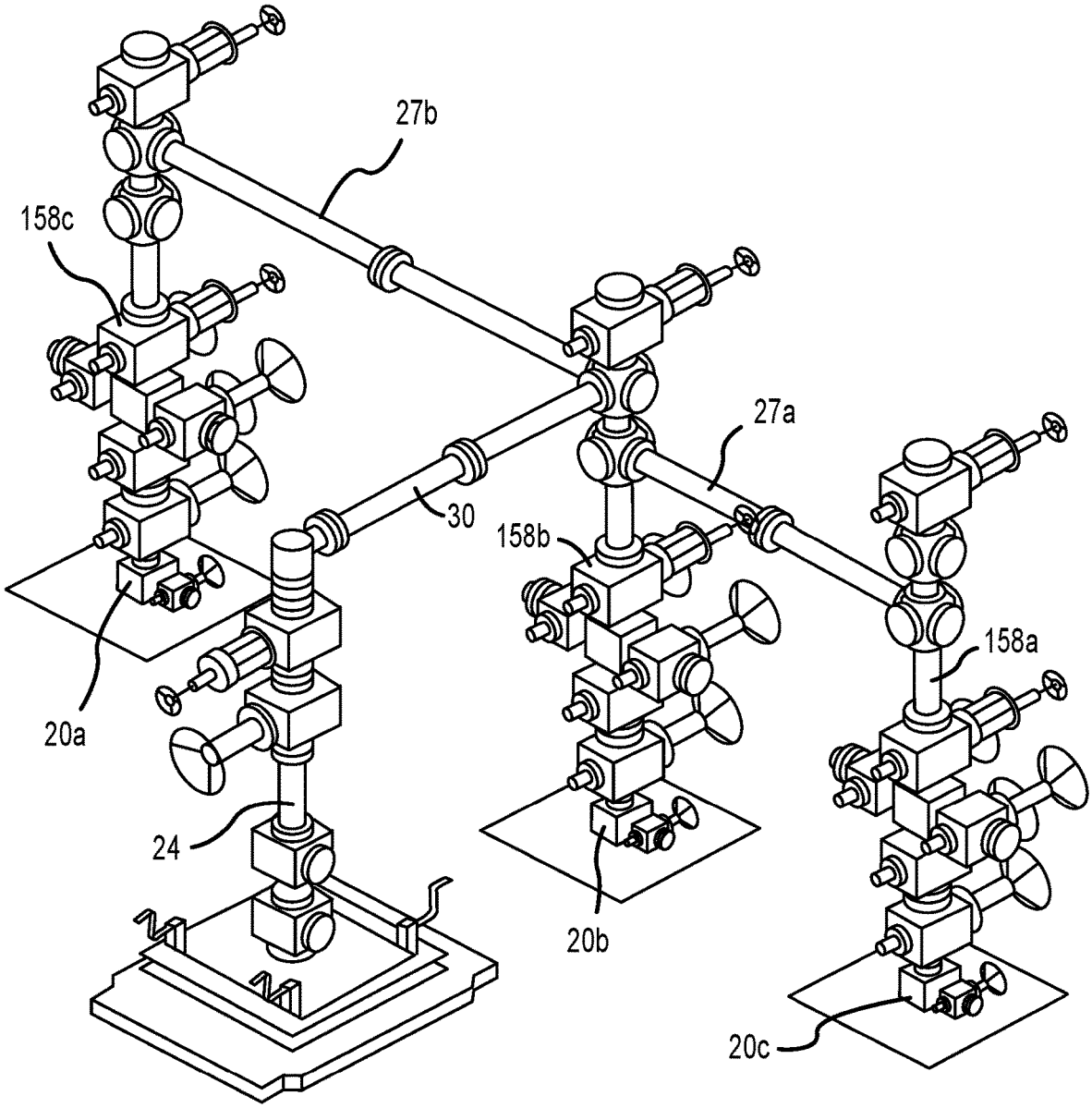
FIG. 3 illustrates a rear perspective of the system of FIG. 2.
Figure 4:
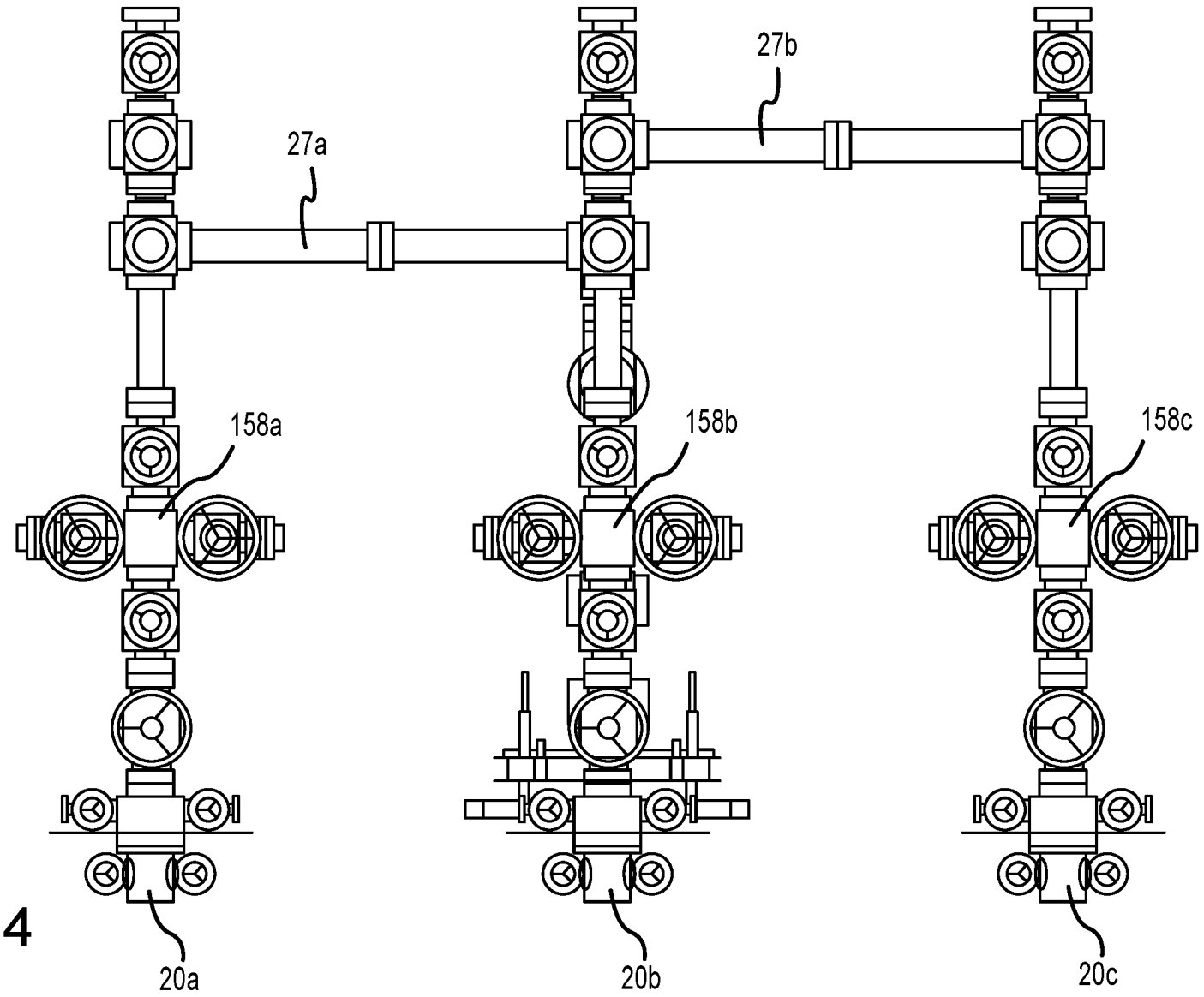
FIG. 4 is a side view of the system of FIGS. 2 and 3.
Figure 5:
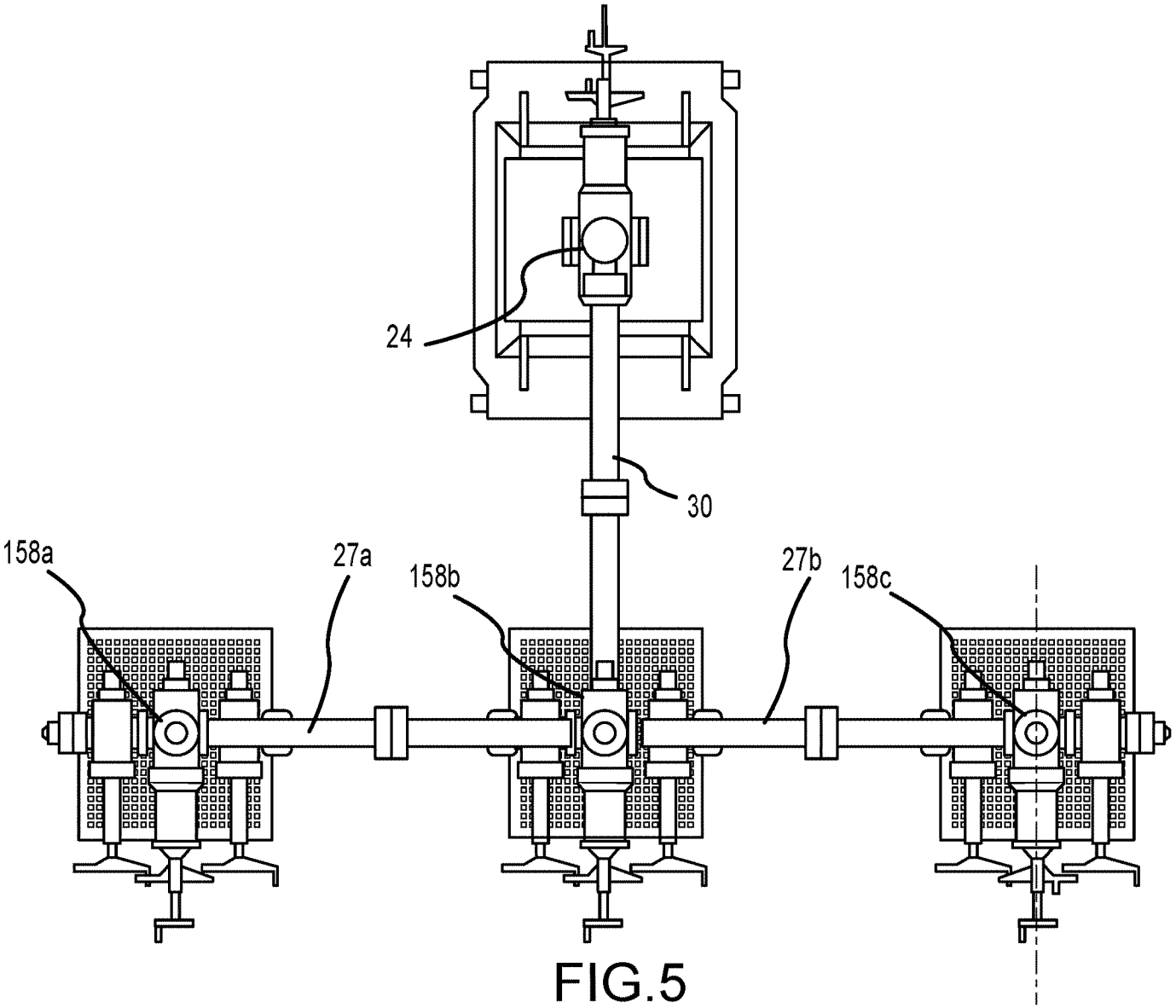
FIG. 5 is a top view of the system of FIGS. 2-4.

In the embodiment illustrated in FIGS. 2 and 3, the frac tree 50*a* is connected to the frac tree 50*b* through a OSL connection 27*a*, and similarly, frac tree 50*c* is connected to frac tree 50*b* through single straight-line connection 27*c*. In some examples, the zipper module 24 is connected to only (relative to the frac trees) frac tree 50*b*. However, in other examples, the zipper module 24 can be connected only to frac tree 50*a* or, in other embodiments, the zipper module 24 is connected only to the frac tree 50*c*. During operation of the embodiment illustrated in FIGS. 2-5, pressurized frack fluid is pumped to the zipper module 24 from the various components illustrated in FIG. 1, and distributed from the zipper module 24 to the frac tree 50*b* via the OSL connection 30. In turn, frac tree 50*b* is connected to the other frac trees 50*a* and 50*c* via the respective single straight-line connections 27*a* and 27*b*, providing pathways for the frac fluid to be dispersed to the various frac trees 50*a* and 50*c*. It should be understood that in the embodiment illustrated in FIGS. 2-5, additional frac trees 50 can be used depending on the particular need and additional single straight-line connections may be used to fluidly connect additional frac trees 50, providing a scalable architecture for distributing frack fluid to a multitude of disparate frac trees 50 atop wellheads 20.

It should be noted that the frac trees 50*a*, 50*b* and 50*c* illustrated in FIGS. 2-5 show one particular configuration, however, the frac trees 50*a*, 50*b*, and/or 50*c* may be otherwise configured. In particular, the frac trees may incorporate any combination of valves (e.g., gate, plug, or the like), tees connectors, y connectors, pipes, or other frac iron may be used to define fluid channels for frac fluid.

Figure 6:
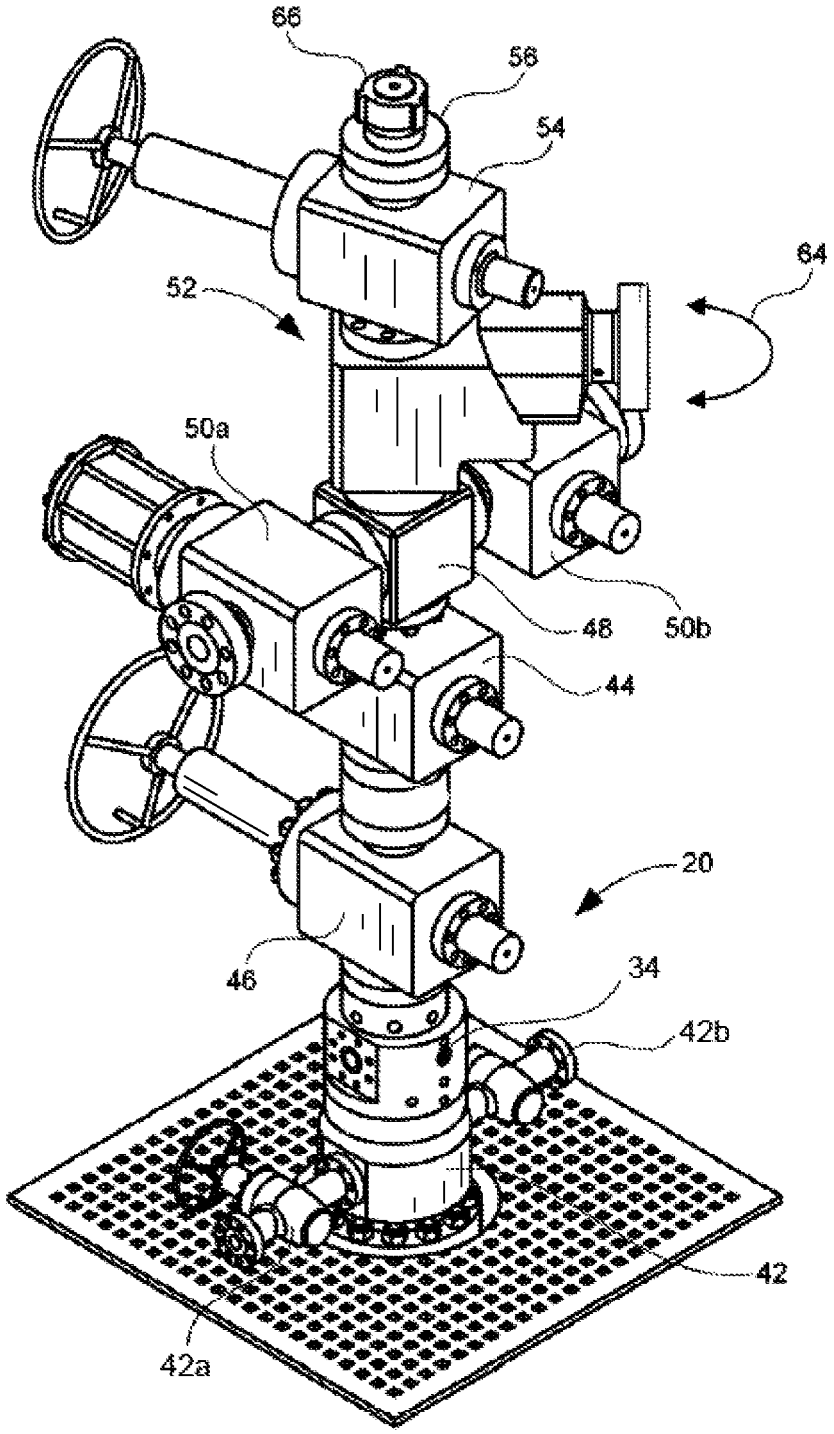
FIG. 6 illustrates a perspective view of an embodiment of a frac tree.

For example, in the embodiment illustrated in FIG. 6, the frac tree 50 includes an adapter 42 mounted with opposing side valves, such as, for example wing gate valves 42*a* and 42*b*; a pair of master valves, such as, for example, upper and lower gate valves 44 and 46, a production tee 48, a multi-way block 52, a swab valve 54 (e.g., a gate valve), and a tree adapter 56. In some embodiments, the upper and lower gate valves 44 and 46 are connected to each other in series above the adapter 42. In some embodiments, the upper gate valve 44 is an automatic gate valve, and the lower gate valve 46 is a manual gate valve. However, other valves besides gate valves may be used. For example, plug valves replace the shown upper and lower gate valves 44 and 46 in some embodiments.

The adapter 42 is connected to the lower gate valve 46 and facilitates connection of the wellhead 20 to a casing string (not shown) and/or a tubing string (not shown) extending within the associated wellbore. The production tee 48 is connected to the upper gate valve 44 and has a production wing valve 50*a* and a kill wing valve 50*b* connected thereto.

The multi-way block 52 is connected to the production tee 48, opposite the upper gate valve 44, and includes a block with a fluid conduit for receiving frac fluid from the zipper module 24 via an OSL connection and directing the received frac fluid downward through a fluid channel defined by the production tee 48, gate valves 44 and 46, and a production spool 34. The multi-way block 52 may take the form of a three-way valve, as depicted in FIG. 6, as a five-way valve, or a as a two-way valve (without the upper swab valve 54). As depicted by arrow 64, the multi-way block 52 is rotatable around an axis defined by the fluid channel in the frac tree 50 (e.g., a vertical axis). For example, the multi-way block 52 may be rotated 360 degrees or less to properly align with an OSL connection from a zipper module 24. This provides at least one rotational degree of flexibility for connecting zipper modules 24 to the frac tree 50.

Figure 7:
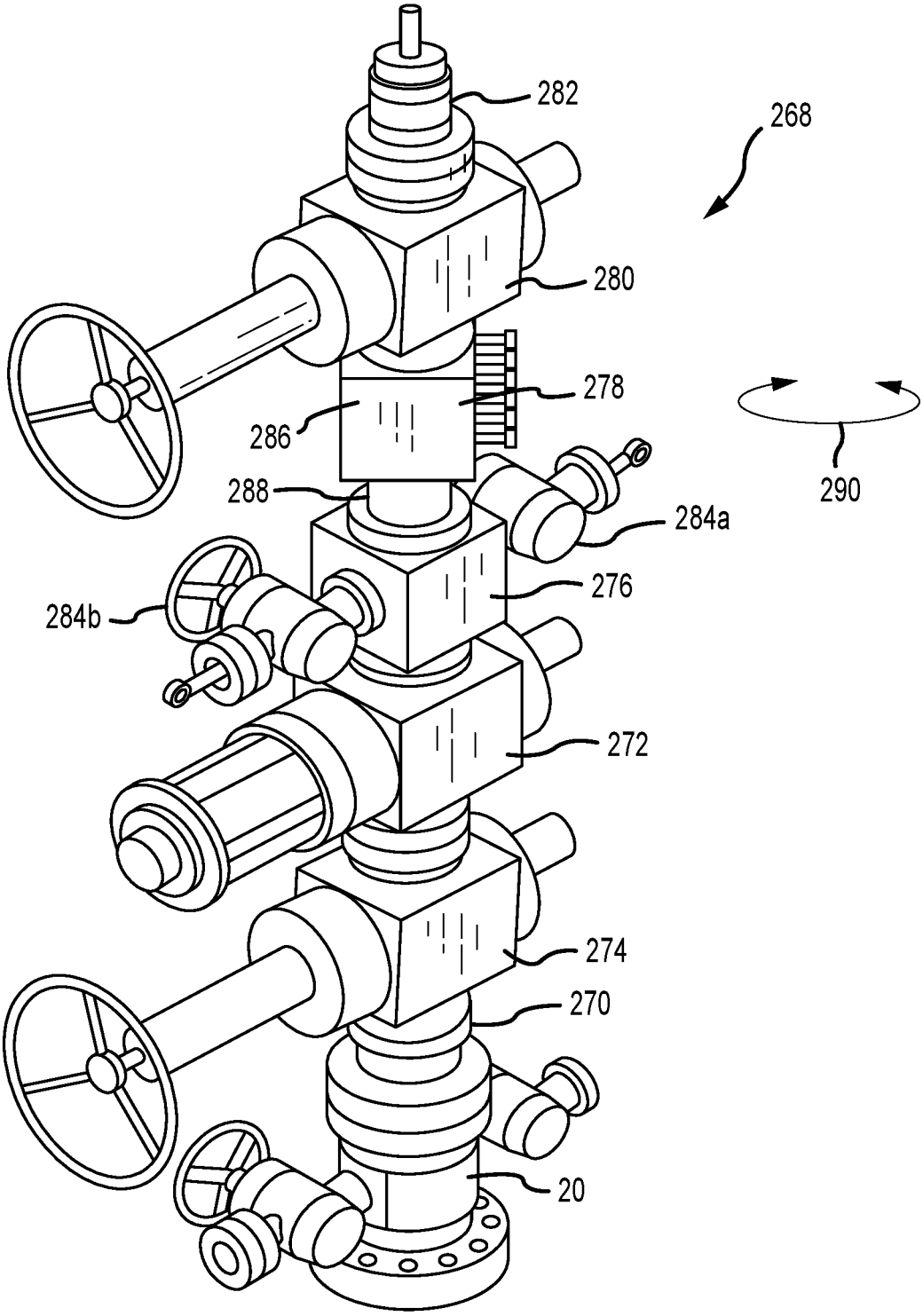
FIG. 7 illustrates a perspective view of another embodiment of a frac tree.

FIG. 7 illustrates another embodiment of frac tree 50. Frac tree 50 includes an adapter spool 80, a pair of master valves, such as, for example, upper and lower gate valves 82 and 84, a production tee 86, a swivel assembly 88, a swab valve, such as, for example, a gate valve 90, and a tree adapter 92. The upper and lower gate valves 82 and 84 are operably coupled in series to one another above the adapter spool 80. In several examples, the upper gate valve 82 of the frac stack is an automatic gate valve, and the lower gate valve 84 is a manual gate valve. The adapter spool 80 facilitates the connection between different sized flanges of the wellhead 20 and the lower gate valve 84. The production tee 86 is operably coupled to the upper gate valve 82 and includes a production wing valve 94 and a kill wing valve 95 connected thereto. The swivel assembly 88 is operably coupled to the production tee 86, opposite the upper gate valve 82, and includes a swivel tee 96 rotatably connected to a swivel spool 98. The swivel tee 96 of the frac stack is configured to rotate about a vertical axis and relative to the swivel spool 98, the production tee 86, the upper and lower gate valves 82 and 84, and the adapter spool 80, as indicated by the curvilinear arrow 100 in FIG. 7. The tree adapter 92 is operably coupled to the gate valve 90 opposite the swivel assembly 88, and includes a cap and gauge connected thereto to verify closure of the gate valve 90.

Figure 8:
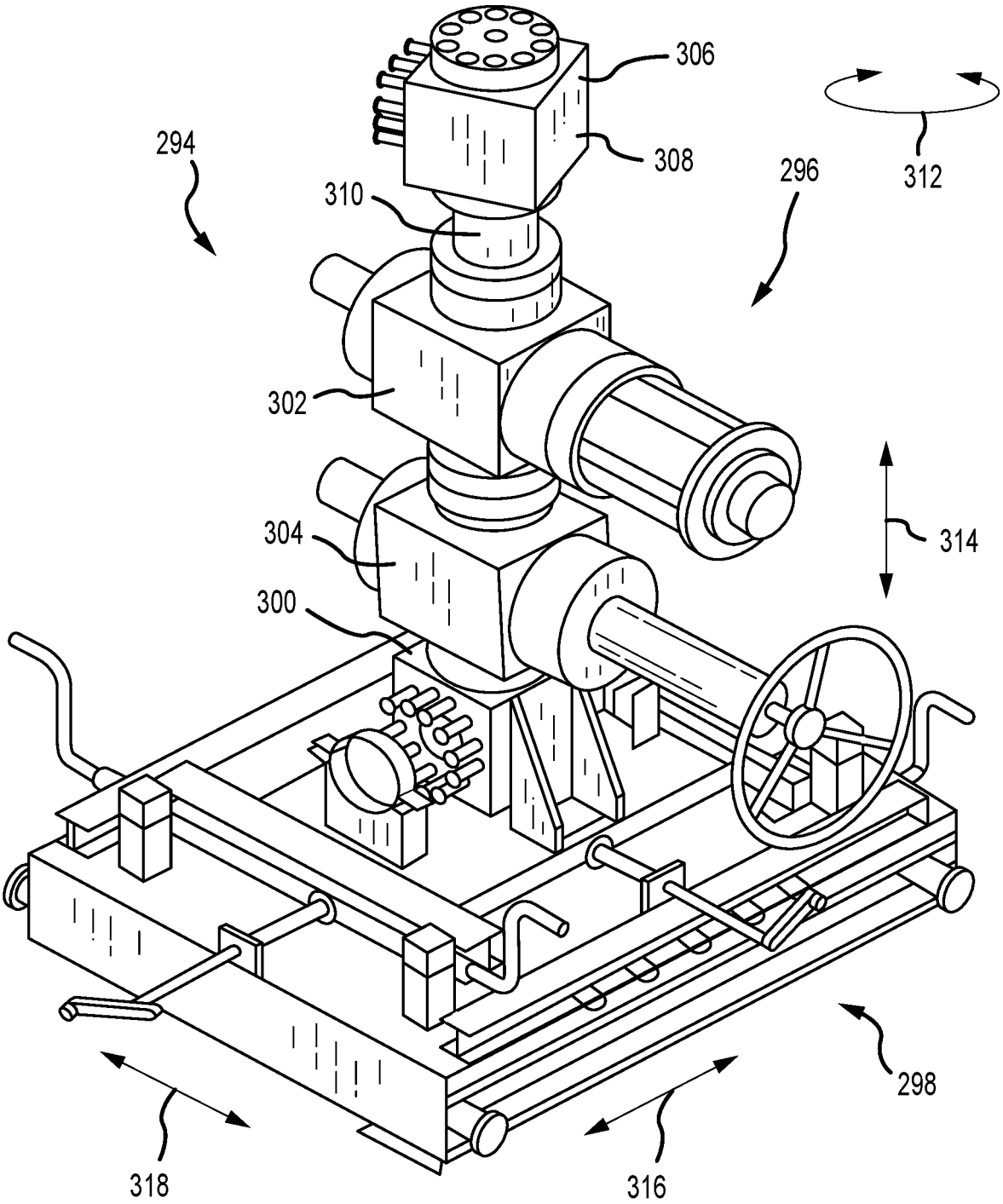
FIG. 8 illustrates a perspective view of an embodiment of a zipper module.

FIG. 8 illustrates an example of a zipper module 20 The depicted zipper module 20 includes a vertical zipper stack 296 supported by an adjustable zipper skid 298, a connection tee 300, a pair of valves, such as, for example, upper and lower gate valves 302 and 304, and a swivel assembly 306. The upper and lower gate valves 302 and 304 are operably coupled in series to one another, the lower gate valve 304 being operably coupled to the connection tee 300. In several examples, the upper gate valve 302 of the vertical zipper stack 296 is an automatic gate valve, and the lower gate valve 304 is a manual gate valve. The swivel assembly 306 is operably coupled to the upper gate valve 302, opposite the lower gate valve 304 and the connection tee 300, and includes a swivel tee 308 rotatably connected to a swivel spool 310. The swivel tee 308 of the vertical zipper stack 296 may be configured to rotate about a vertical axis and relative to the swivel spool 310, the upper and lower gate valves 302 and 304, and the connection tee 300, as indicated by the curvilinear arrow 312 in FIG. 8.

The adjustable zipper skid 298 is configured to displace the zipper module 24 to align the swivel tee 308 of the zipper module 294*a* with the corresponding swivel tee 286 of the single frac tree 158 that is connected to the zipper module 24. More particularly, the adjustable zipper skid 298 is configured to displace the zipper module 24 up and down in the vertical direction, and back and forth in at least two horizontal directions, as indicated by the linear arrows 314, 316, and 318, respectively. In several embodiments, the vertical direction 314 and the at least two horizontal directions 316 and 318 are orthogonal.

Additionally or alternatively, any of the disclosed valves shown in the zipper modules, frac trees, large-bore iron fluid lines of the assembly manifolds (including the high- and low-pressure lines/manifolds), or the single straight-line connections may be electronically controlled and/or monitored (e.g., opened or closed) by a local or remote computer, either on the skids, trailers, or manifolds, or from a remote location. In this vein, one more computing devices (e.g., server, laptop, mobile phone, mobile tablet, personal computer, kiosk, or the like) may establish a connection with one or more processors, integrated circuits (ICs), application-specific ICs (ASICs), systems on a chip (SoC), microcontrollers, or other electronic processing logic to open and control the disclosed valves, which in some examples, are actuated through electrical circuitry and/or hydraulics.

Although described in connection with an exemplary computing device, examples of the disclosure are capable of implementation with numerous other general-purpose or special-purpose computing system environments, configurations, or devices. Examples of well-known computing systems, environments, and/or configurations that may be suitable for use with aspects of the disclosure include, but are not limited to, smart phones, mobile tablets, mobile computing devices, personal computers, server computers, hand-held or laptop devices, multiprocessor systems, gaming consoles, microprocessor-based systems, network PCs, minicomputers, mainframe computers, distributed computing environments that include any of the above systems or devices, and the like.

Aspects disclosed herein may be performed using computer-executable instructions, such as program modules, executed by one or more computers or other devices in software, firmware, hardware, or a combination thereof. The computer-executable instructions may be organized into one or more computer-executable components or modules embodied—either physically or virtually—on non-transitory computer-readable media, which include computer-storage memory and/or memory devices. Generally, program modules include, but are not limited to, routines, programs, objects, components, and data structures that perform particular tasks or implement particular abstract data types. Aspects of the disclosure may be implemented with any number and organization of such components or modules. For example, aspects of the disclosure are not limited to the specific computer-executable instructions or the specific components or modules illustrated in the figures and described herein. Other examples of the disclosure may include different computer-executable instructions or components having more or less functionality than illustrated and described herein. In examples involving a general-purpose computer, aspects of the disclosure transform the general-purpose computer into a special-purpose computing device when configured to execute the instructions described herein.

Exemplary computer-readable media include flash memory drives, digital versatile discs (DVDs), compact discs (CDs), floppy disks, and tape cassettes. By way of example and not limitation, computer readable media comprise computer storage media and communication media. Computer storage media include volatile and nonvolatile, removable and non-removable media implemented in any method or technology for storage of information such as computer readable instructions, data structures, program modules or other data. Computer storage media are tangible and mutually exclusive to communication media. Computer storage media are implemented in hardware, are non-transitory, and exclude carrier waves and propagated signals. Computer storage media for purposes of this disclosure are not signals per se. Exemplary computer storage media include hard disks, flash drives, and other solid-state memory. In contrast, communication media typically embody computer readable instructions, data structures, program modules, or other data in a modulated data signal such as a carrier wave or other transport mechanism and include any information delivery media.

It is understood that variations may be made in the foregoing without departing from the scope of the disclosure.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, or one or more of the procedures may also be performed in different orders, simultaneously or sequentially. In several exemplary embodiments, the steps, processes or procedures may be merged into one or more steps, processes or procedures. In several exemplary embodiments, one or more of the operational steps in each embodiment may be omitted. Moreover, in some instances, some features of the present disclosure may be employed without a corresponding use of the other features. Moreover, one or more of the exemplary embodiments disclosed above, or variations thereof, may be combined in whole or in part with any one or more of the other exemplary embodiments described above, or variations thereof.

Although several "exemplary" embodiments have been disclosed in detail above, "exemplary," as used herein, means an example embodiment, not any sort of preferred embodiment the embodiments disclosed are exemplary only and are not limiting, and those skilled in the art will readily appreciate that many other modifications, changes, and substitutions are possible in the exemplary embodiments without materially departing from the novel teachings and advantages of the present disclosure. Accordingly, all such modifications, changes, and substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. A system, comprising:

a first frac tree connected to a first wellbore;

a second frac tree connected to a second wellbore; and a single zipper module comprising a first valve, a second valve, and flow iron defining a vertical fluid channel, wherein the single zipper module is connected to only the first frac tree, of the first and second frac trees, via a first single straight-line connection including one or more pipes defining a first straight internal flow path between the single zipper module and the first frac tree, and wherein the second frac tree is connected to the first frac tree, via a second single straight-line connection including one or more pipes defining a second straight internal flow path between the first frac tree and the second frac tree.

2. The system of claim 1, wherein fluid channels are defined within the first frac tree, the second frac tree, the first single straight-line connection, and the second single straight-line connection for hydraulic fracturing fluid to be supplied from the single zipper module to the first frac tree and the second frac tree.

3. The system of claim 1, further comprising:

a third frac tree connected to a third wellbore; and a third single straight-line connection between the second frac tree and the third frac tree.

4. The system of claim 1, wherein the single zipper module is situated on a base that is adjustable in elevation.

5. The system of claim 1, wherein the single zipper module comprises at least one rotatable block for receiving a frac fluid.

6. The system of claim 1, further comprising a third valve and a fourth valve, the first single straight-line connection extending between the third and fourth valves.

7. The system of claim 6, wherein the first, second, third, and fourth valves are at least one of manually actuatable or automatically actuatable.

8. The system of claim 6, wherein the first, second, third, and fourth valves are selected from the group consisting of a plug valve, a gate valve, and a ball valve.

9. A system for delivering hydraulic fracturing fluid to a wellbore, the system comprising:

a plurality of pumps fluidly connected to a manifold for delivering fluid to a zipper module, the zipper module comprising a first valve and a second valve and defining a vertical fluid flow path;

a first frac tree adapted to be connected to a first wellbore; and a second frac tree adapted to be connected to a second wellbore, wherein the zipper module is connected to only the first frac tree, of the first and second frac trees, via a first single straight-line connection between the zipper module and the first frac tree, and wherein the second frac tree is connected to the first frac tree, via a second single straight-line connection between the first frac tree and the second frac tree.

10. The system of claim 9, further comprising:

a third frac tree adapted to be connected to a third wellbore; and a third single straight-line connection between the first frac tree and the third frac tree.

11. The system of claim 9, further comprising:

a third frac tree adapted to be connected to a third wellbore; and a third single straight-line connection between the second frac tree and the third frac tree.

12. The system of claim 9, wherein fluid channels are defined within the first frac tree, the second frac tree, the zipper module, the first single straight-line connection, and the second straight-line connection for the fluid to be supplied from the zipper module to the first frac tree and the second frac tree.

13. The system of claim 9, wherein the zipper module is situated on a base that is adjustable in elevation.

14. The system of claim 9, wherein the zipper module comprises at least one rotatable block for receiving the fluid.

15. A method for delivering hydraulic fracturing fluid to a wellbore, the method comprising:

positioning a zipper module for connection to a first frac tree and a second frac tree, the zipper module comprising at least two valves and defining a vertical fluid flow path;

coupling a first single straight line connection to the zipper module and the first frac tree to fluidly connect the zipper module and the first frac tree; and coupling a second single straight line connection to the first frac tree and the second frac tree to fluidly connect the first frac tree and the second frac tree, wherein the zipper module is connected to only the first frac tree, of the first and second frac trees.

16. The method of claim 15, further comprising coupling a third single straight line connection to the first frac tree to fluidly connect the first frac tree and a third frac tree.

17. The method of claim 15, further comprising coupling a third single straight line connection to the second frac tree to fluidly connect the second frac tree to a third frac tree.

18. The method of claim 15, further comprising providing a base to support the zipper module and adjusting the elevation of the zipper module with respect to the base.

19. The method of claim 15, further comprising providing a rotatable block on the zipper module to rotationally position at least a portion of the zipper module.

20. The method of claim 15, further comprising providing a third valve and a fourth valve, wherein the first single straight line connection extends between the third and fourth valves.

* * * * *